US009998835B2

(12) United States Patent
Daley et al.

(10) Patent No.: US 9,998,835 B2
(45) Date of Patent: Jun. 12, 2018

(54) TRANSDUCER COMPONENTS AND STRUCTURE THEREOF FOR IMPROVED AUDIO OUTPUT

(71) Applicant: GOOGLE LLC, Mountain View, CA (US)

(72) Inventors: Michael J. Daley, Santa Clara, CA (US); Timothy Whitwell, North Point (CN)

(73) Assignee: GOOGLE LLC, Mountain View, CA (US)

( * ) Notice: Subject to any disclaimer, the term of this patent is extended or adjusted under 35 U.S.C. 154(b) by 0 days. days.

(21) Appl. No.: 15/648,169

(22) Filed: Jul. 12, 2017

(65) Prior Publication Data

US 2017/0311085 A1 Oct. 26, 2017

Related U.S. Application Data

(63) Continuation of application No. 14/664,442, filed on Mar. 20, 2015, now Pat. No. 9,736,592.

(51) Int. Cl.

| | |
|---|---|
| ***H04R 1/00*** | (2006.01) |
| ***H04R 9/06*** | (2006.01) |
| *H04R 1/28* | (2006.01) |
| *H04R 7/18* | (2006.01) |
| *H04R 9/04* | (2006.01) |

(52) U.S. Cl.

CPC ..... *H04R 9/06* (2013.01); *H04R 9/063* (2013.01); *H04R 1/2811* (2013.01); *H04R 7/18* (2013.01); *H04R 9/045* (2013.01); *H04R 2420/09* (2013.01); *H04R 2499/11* (2013.01)

(58) Field of Classification Search

CPC ..... H04R 7/18; H04R 9/045; H04R 1/2811; H04R 2420/09; H04R 2499/11; H04R 7/20; H04R 9/025; H04R 9/06; H04R 9/063; H02K 2203/03; H02K 33/16; H02K 3/525

USPC ..... 381/401–412, 370–389

See application file for complete search history.

(56) References Cited

U.S. PATENT DOCUMENTS

| | | | | |
|---|---|---|---|---|
| 6,404,896 | B1 | 6/2002 | Yoo et al. | |
| 8,411,882 | B2 | 4/2013 | Lee et al. | |
| 8,548,191 | B2 | 10/2013 | Stead | |
| 8,798,310 | B2 | 8/2014 | Booth et al. | |
| 8,811,648 | B2 | 8/2014 | Pance et al. | |
| 2003/0022702 | A1 | 1/2003 | Usuki et al. | |
| 2006/0256997 | A1* | 11/2006 | Sagren | H04R 1/24 381/412 |
| 2008/0259467 | A1* | 10/2008 | Chung | G02B 7/08 359/814 |

(Continued)

*Primary Examiner* — Matthew Eason
*Assistant Examiner* — Julie X Dang
(74) *Attorney, Agent, or Firm* — Marshall, Gerstein & Borun LLP

(57) ABSTRACT

Embodiments are provided for components configured for audio playback. According to certain aspects, a transducer includes dual voice coils disposed in a magnet section, whereby the magnet section generates an electromagnetic field that causes the dual voice coils to actuate in response to an applied audio signal. The transducer further includes a diaphragm coupled to the dual voice coils that actuates according to the dual voice coils and produces audio output. In some implementations, the transducer may be disposed within a cutout area of an electronic device, whereby the transducer is secured to the electronic device via a roll-surround suspension.

20 Claims, 8 Drawing Sheets

(56) References Cited

U.S. PATENT DOCUMENTS

| | | | | |
|---|---|---|---|---|
| 2009/0136075 | A1* | 5/2009 | Meyer | H04R 9/063 381/386 |
| 2009/0208048 | A1 | 8/2009 | Haas | |
| 2009/0304223 | A1* | 12/2009 | Chang | H04R 9/025 381/412 |
| 2012/0008816 | A1* | 1/2012 | Liu | H04R 9/063 381/401 |
| 2012/0106775 | A1* | 5/2012 | Shao | H04R 9/043 381/412 |
| 2012/0177246 | A1* | 7/2012 | Shi | H01F 7/0289 381/398 |
| 2012/0263341 | A1 | 10/2012 | Stead | |
| 2013/0213628 | A1* | 8/2013 | Litovsky | H04R 1/2834 165/185 |
| 2014/0056464 | A1* | 2/2014 | Li | H04R 9/025 381/400 |
| 2014/0072159 | A1 | 3/2014 | Moulton et al. | |
| 2015/0016659 | A1* | 1/2015 | Wang | H04R 9/06 381/412 |
| 2015/0086066 | A1* | 3/2015 | Yan | H04R 9/025 381/412 |
| 2015/0117699 | A1 | 4/2015 | Cai et al. | |

* cited by examiner

TRANSDUCER COMPONENTS AND STRUCTURE THEREOF FOR IMPROVED AUDIO OUTPUT

CROSS-REFERENCE TO RELATED APPLICATIONS

This application is a continuation of U.S. patent application Ser. No. 14/664,442, filed Mar. 20, 2015, which is incorporated herein by reference in its entirety.

FIELD

This application generally relates to transducer components configured for audio output. In particular, the application relates to a transducer design configurable for implementation in various electronic devices to facilitate audio output.

BACKGROUND

Various known electronic devices support audio playback or output through audio components such as built in speakers. For example, a user may use a built in speaker for audio playback in situations in which the user does not have or does not wish to use headphones or earbuds. In existing electronic devices, the built-in speakers lack substantial acoustic source strength. This is sometimes due to the generally small size of some electronic devices such as smart phones, whereby it is undesirable for the speakers to take up a large surface area of the electronic device. Further, existing speakers do not take advantage of the maximum amount of air volume in electronic devices, which impacts excursion ability and therefore the acoustic response.

Accordingly, there is an opportunity to implement acoustic components that allow for improved audio playback.

BRIEF DESCRIPTION OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed embodiments, and explain various principles and advantages of those embodiments.

DETAILED DESCRIPTION

Figure 1:
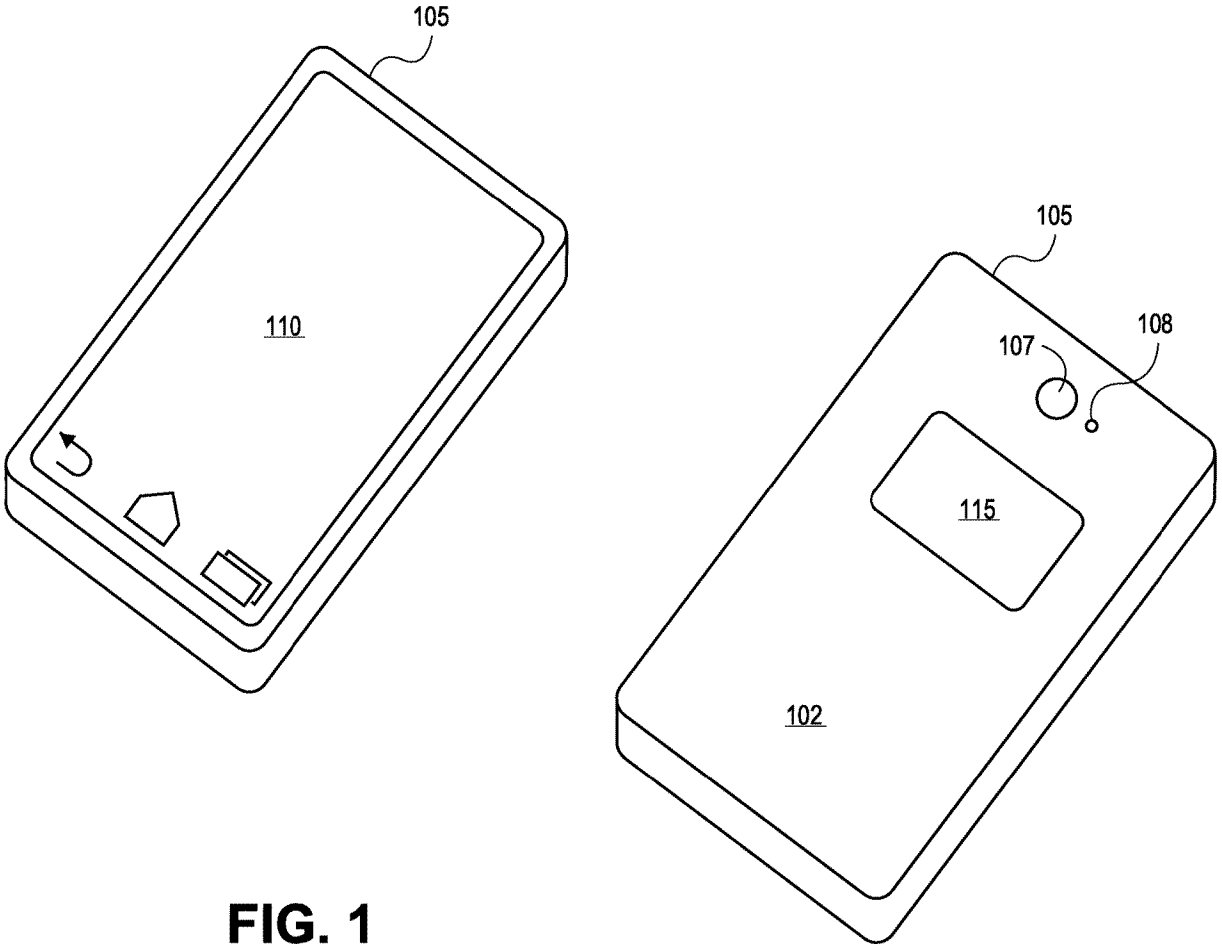
FIG. 1 depicts an example representation of an electronic device capable of facilitating audio output in accordance with some embodiments.

Embodiments as detailed herein enable an electronic device to play or output audio via a transducer and associated components that in combination leverage the design of an associated electronic device. In particular, the transducer and associated components leverage the surface area of the electronic device, which enables larger audio components and results in better acoustic source strength. In conventional devices, the speakers have to be specially designed to fit the associated device and, to produce adequate sound, often take up valuable space within the device. Further, the speakers often do not leverage an existing air volume of the device. According to embodiments, a "motor structure" of the transducer is designed to efficiently facilitate audio output while accounting for the space limitations. Further, the design of the transducer and associated motor structure eliminates the need for an amount of interior volume in the electronic device that is otherwise necessary in conventional speaker designs.

Generally, a motor structure of a transducer facilitates electromagnetic motion that results in audio output, where the motor structure may include at least a set of magnets, one or more voice coils, and gap(s) that enable motion resulting from generated magnetic fields. According to the present embodiments, the motor structure is designed to allow for space savings while also improving audio output quality. The orientation of the magnets of the motor structure enables the generation of a magnetic field and allows for suitable gaps. Dual voice coils affected by the magnetic field are disposed within the gaps of the magnet structure, whereby a diaphragm may be secured to the voice coils.

The transducer may be installed as part of an electronic device. In some implementations, the electronic device includes an exterior casing the encloses various interior components. For example, an exterior casing of a smartphone may include a front-side display screen or user interface and/or a back-side enclosure. The exterior casing includes a cutout area (e.g., a cutout rectangle that is formed on the exterior casing) in which a diaphragm of the transducer may be disposed. In particular, the diaphragm may be disposed in the exterior casing such that at least a portion of the diaphragm is substantially co-planar with at least the perimeter of the exterior casing surrounding the cutout area. Accordingly, the diaphragm does not protrude from the exterior casing. The diaphragm may be secured to the exterior casing via various techniques or implementations such as a roll-surround suspension that enables excursion of the diaphragm.

In operation, the transducer receives an audio signal from a power source, where the audio signal causes the voice coils to correspondingly vibrate. The vibrations from the voice coils cause the diaphragm to actuate (i.e., vibrate) and produce acoustic sound. The sound produced by the diaphragm may be enhanced by the air volume that is exposed to the diaphragm, which facilitates effective excursion of the diaphragm. In some embodiments, a port formed through the external casing may further enhance the frequency response of the sound produced by the diaphragm.

The embodiments as discussed herein offer many benefits. In particular, the diaphragm and transducer components can leverage a larger surface area of the electronic device which results in an air volume deflection that is greater than what is possible in a conventional device speaker. Further, the diaphragm and transducer do not require the extra volume of air that exists between the diaphragm and device housing in conventional diaphragm designs, which represents a space savings that enables more design possibilities. Of course, the embodiments further offer benefits to device users, as the transducer produces quality sound that is enhanced by leveraging the air volume already defined in the electronic device.

It should be noted that the disclosures in this specification are made and intended to be interpreted to their broadest extent under the patent laws, and that while the systems and methods described herein may be employed broadly in numerous applications and embodiments consistent with their capabilities, nothing in this disclosure is intended to teach, suggest, condone, or imply noncompliance with any other law or regulation that may be applicable to certain usages or implementations of the systems and methods. For example, while the systems and methods disclosed herein are technologically capable of playback of media files, such capabilities and functionalities should not be construed as a teaching, recommending, or suggesting use of such capabilities and functionalities in a manner that does not comply with all applicable existing laws and regulations, including without limitation, applicable national, state, and common law privacy or copyright laws. Again, such broad disclosure is intended for compliance with and interpretation under the patent laws and regulations.

FIG. 1 depicts multiple views of an example electronic device 105 capable of facilitating acoustic output. The electronic device 105 may be, for example, a handheld wireless device, such as a mobile phone, a Personal Digital Assistant (PDA), a smartphone, a tablet or laptop computer, a multimedia player, an MP3 player, a digital broadcast receiver, a remote controller, or any other electronic apparatus. Although the embodiments envision the electronic device 105 as portable and hand-held, it should be appreciated that other non-portable devices are envisioned.

At least a portion of the electronic device 105 may include an exterior casing 102 that takes up various portions or exterior surfaces of the electronic device 105. The exterior casing 102 may be designed to house or enclose various interior components of the electronic device 105. The exterior casing 102 may include one or multiple pieces or components, and may be composed of various materials (e.g., plastic, metal, glass, etc.) or combinations of materials. For example, an exterior casing 102 of a smartphone may include a front-side display screen or user interface and a back-side non-display screen surface. It should be appreciated that the external casing 102 of an electronic device may include all non-display screen components.

The left side of FIG. 1 illustrates a front side or surface of the electronic device 105. In particular, the front side of the electronic device 105 includes a user interface 110 (which can include a display screen and various I/O components, as understood in the art). The right side of FIG. 1 illustrates a back side or surface of the electronic device 105 (or otherwise the side opposite from the user interface 110). The back side of the electronic device 105 can optionally include an imaging sensor (i.e., a camera) 107 and an associated flash component 108. It should be appreciated that the components and arrangements thereof that are included on either the front side or the back side of the electronic device 105 are merely examples, and that alternative or additional components and arrangements thereof are envisioned.

The exterior casing 102 of the back side of the electronic device 105 may have a cutout area formed therethrough or thereon. The cutout area may be sized and adapted to fit a transducer 115 (sometimes referred to as a "driver") that is configured to facilitate acoustic output originating as an audio signal within the electronic device 105. The transducer 115 may be secured to the electronic device 105 via various techniques or components, as described in further figures. FIG. 1 illustrates the transducer 115 (and associated cutout area) as roughly centered in the top half of the back side of the electronic device 105 and roughly one eighth (⅛) the surface area of the back side of the electronic device. However, it should be appreciated that the positioning, size, and shape of the transducer 115 (and cutout area) are merely examples and other positions, sizes, and shapes for the transducer 115 (and cutout area) are envisioned. Further, although it is described that the transducer 115 may be installed as part of the electronic device 105, it should be appreciated that other applications for the transducer 115 are envisioned. In particular, the transducer 115 may be installed or incorporated as part of any device, component, or element capable of generating an audio signal input.

Generally, the transducer 115 is an electroacoustic transducer that acts as a loudspeaker that produces sound in response to an electrical audio signal input, whereby the transducer 115 may be composed of several parts or components. In particular, the transducer 115 may generally be composed of a magnet section, one or more voice coils, a diaphragm secured to the voice coils, a suspension mechanism, and/or other components. At least the magnet section and the voice coils are sometimes collectively referred to as a "motor structure."

In operation, when an amplifier applies an electrical signal to a voice coil, a magnetic field is created by the electric current in the voice coil, effectively making it a variable electromagnet. The voice coil and the magnet section interact, generating a mechanical force that causes the voice coil to actuate back and forth. Because the diaphragm is secured to the voice coil, the diaphragm will also actuate back and forth, thereby reproducing sound according to the applied electrical signal from the amplifier. The suspension mechanism stabilizes the diaphragm (and also secures it to another component such as the exterior casing 102) and enables the displacement or vibration (i.e., excursion) capability of the diaphragm and therefore enhances the frequency response of the audio output.

Figure 2:
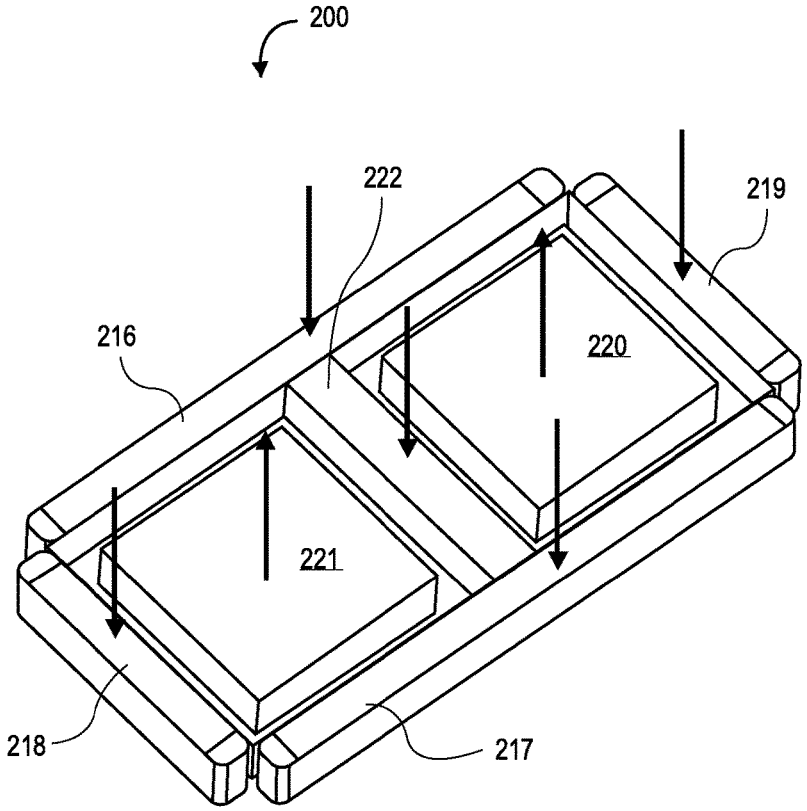
FIG. 2 depicts an example arrangement of magnets to be included in a motor structure in accordance with some embodiments.

FIG. 2 illustrates a magnet section 200 to be included in a motor structure of a transducer, according to some embodiments. The magnet section 200 includes multiple separate magnets. Each of the separate magnets may be composed of various ferromagnetic or ferrimagnetic materials such as, for example, N35 grade NdFeB, or other magnetic materials. As illustrated in FIG. 2, the magnet section 200 can include two interior magnets 220, 221 having the same or similar size and shape, and an additional interior magnet 222 that may be positioned between the two interior magnets 220, 221. The magnet section 220 can further include a set (as shown: four) exterior magnets 216, 217, 218, 219 that may surround the two interior magnets 220, 221 and the additional interior magnet 222. Further, the magnets 216-222 may be arranged such that a gap surrounding each of the interior magnets 220, 221 exists (but where the additional interior magnet 222 contacts or nearly contacts the exterior magnets 216, 217), where the gap enables sufficient tolerance in manufacture and operation while maintaining a substantial magnetic field over a voice coil region. The gap may be of various widths such as, for example, 0.7 mm.

Each of the magnets 216-222 may have the same or similar thickness. For example, the magnets 216-222 may have a thickness in a range of 0.5 mm to 2.0 mm. Generally, the two interior magnets 220, 221 may be substantially square-shaped, and the additional interior magnet 222 and the exterior magnets 216-219 may be substantially rectangle-shaped. However, it should be appreciated that other shapes for the magnets 216-222 are envisioned.

The magnets 216-222 of the magnet section 200 may be arranged in a magnetic orientation that facilitates the generation of a magnetic field. In particular, the magnetic poles or orientations of some of the magnets 216-222 may be opposite from others of the magnets 216-222. As illustrated in FIG. 2, the magnetic poles of the additional interior magnet 222 and the exterior magnets 216-219 are oriented "down" while the magnetic poles of the interior magnets 220, 221 are oriented "up." A resulting magnetic field may cause a voice coil to actuate up and down and facilitate audio output.

Figure 3A:
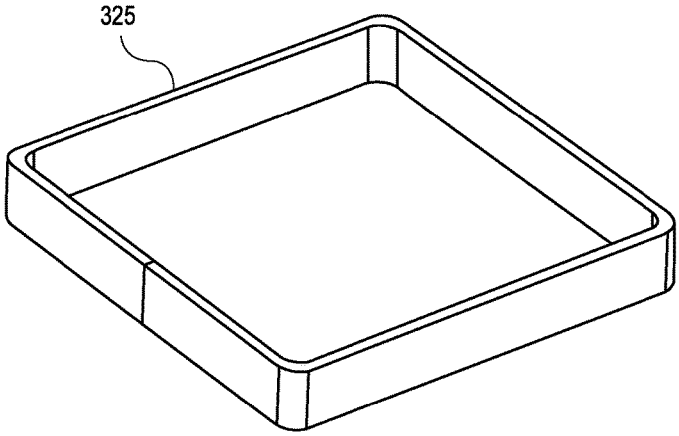
FIG. 3A depicts an example voice coil in accordance with some embodiments.

FIG. 3A illustrates a voice coil 325 that may be included as part of a transducer. The voice coil 325 may be substantially square-shaped and may be of various sizes and composed of various elements. For example, the voice coil 325 may be composed of copper and may have a thickness of about 1.0 mm, and a width and length of about 7.2 mm. For further example, the voice coil 325 may be composed of copper-clad-aluminum wire (CCAW), which may offer weight savings and greater overall efficiency compared to a pure copper coil. Although depicted as a continuous coil, it should be appreciated that the voice coil 325 may be composed of multiple layers having a plurality of individual wire turns. For example, the voice coil 325 may be a 4-layer coil with a total number of turns ranging from 30 to 58 turns.

Figure 3B:
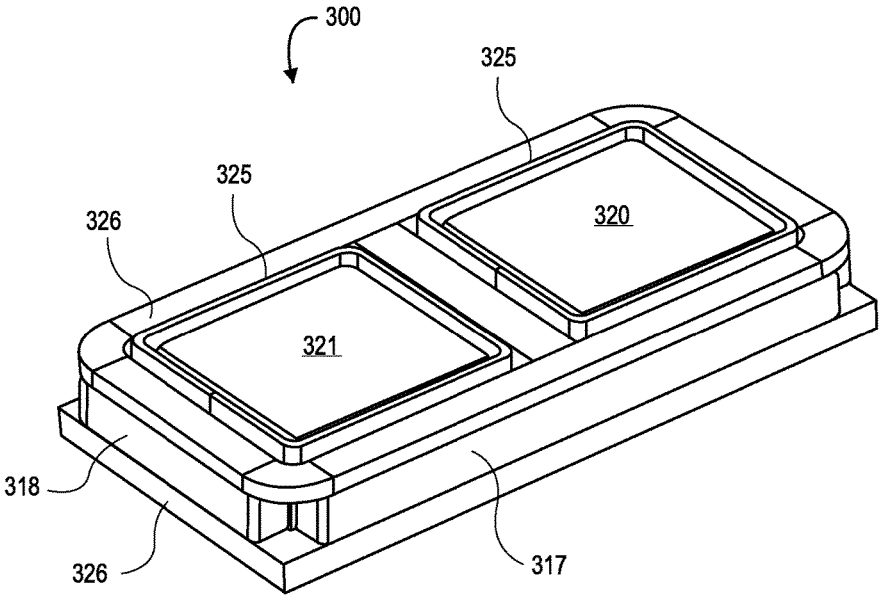
FIG. 3B depicts an example motor structure in accordance with some embodiments.

The voice coil 325 is configured to be disposed in a motor structure 300 as depicted in FIG. 3B (which may include the magnet section 200 as discussed with respect to FIG. 2). As illustrated in FIG. 3B, two voice coils 325 may be disposed within the gaps of the motor structure 300 such that the voice coils 325 respectively surround two interior magnets 320, 321 (while being enclosed by exterior magnets 317, 318). The motor structure 300 as illustrated in FIG. 3B further includes one or more support elements 326. In embodiments, the support elements 326 may be composed of high magnetic permanence steel or iron, or other magnetic permanence materials. The motor structure 300 of FIG. 3B may have various dimensions. For example, the motor structure 300 may have a length of 20.2 mm, a width of 10.5 mm, and a thickness of 2.7 mm.

The dual voice coils 325 of the motor structure 300 are configured to be driven by electric signals of various power, but with greater efficiency than a single voice coil design. In particular, the motor conversion efficiency of the two options (single voice coil and dual voice coils) may be broadly equivalent; however, the reduced thermal losses of the dual coil design (due to the halved current) may result in the dual voice coil design being more efficient, particularly at higher input levels. For example, if a single voice coil having a resistance of 4 Ohms is driven with a 1 W input, the total current generated is 0.5 A. In a dual voice coil design, each of the voice coils 325 has a resistance of 8 Ohms (for a total parallel resistance of 4 Ohms) and are driven with a 1 W input, the total current generated is 0.5 A (0.25 A for each of the voice coils 325). However, if the current load through each voice coil 325 of the dual voice coil design is halved, the heating effect would be halved and the power handling potentially doubled, which could lead to a +3 dB maximum output advantage for the dual voice coil design. Additionally, the dual voice coil design offers improved thermal stability of the interior magnets 320, 321.

Figure 4A:
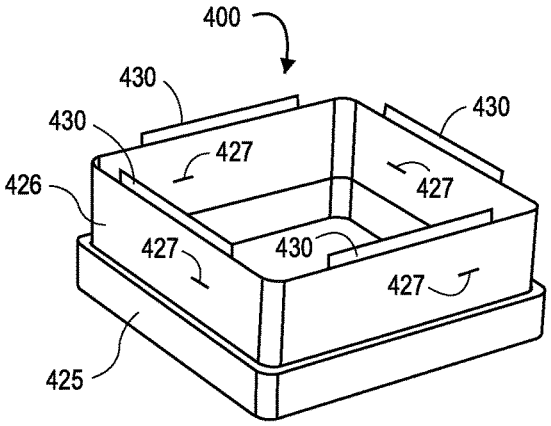
FIG. 4A depicts an example voice coil in accordance with some embodiments.

FIG. 4A illustrates an extended voice coil 400 that may also be included as part of a transducer. The extended voice coil 400 includes a voice coil anterior 425 (which may be the same as or similar to the voice coil 325 as described with respect to FIG. 3A) and a voice coil posterior 426. As illustrated in FIG. 4A, a perimeter of the voice coil posterior 426 is offset from a perimeter of the voice coil anterior 425. Further, each top side of the voice coil posterior 426 can include a tab 430, whereby the tab 430 may be folded over to enable the extended voice coil 400 to be coupled to a diaphragm.

Figure 4B:
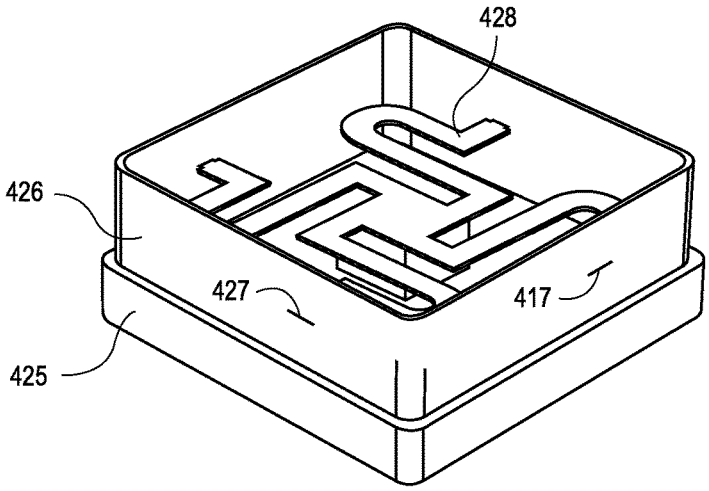
FIG. 4B depicts an example suspension element disposed in a voice coil accordance with some embodiments.
Figure 4C:
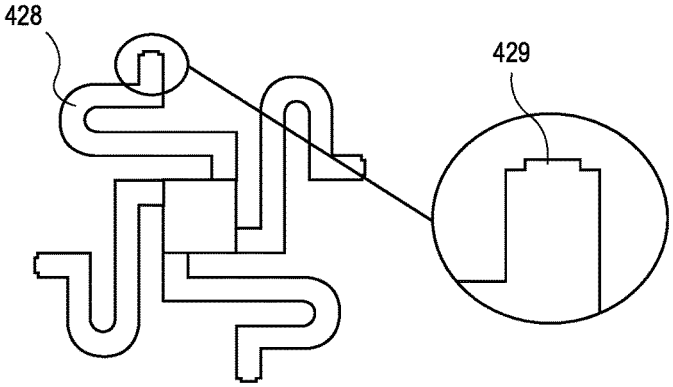
FIG. 4C depicts a detailed view of an example suspension element in accordance with some embodiments.

The voice coil posterior 426 includes a set of slots 427 formed therein, wherein the set of slots 427 are adapted to fit a suspension element. In particular, FIG. 4B illustrates a suspension element 428 that is adapted to fit into the set of slots 427 of the voice coil posterior 426. FIG. 4C depicts a close-up view of the suspension element 428, where each leg of the suspension element 428 includes a tab 429 adapted to fit into one of the respective slots 427. The suspension element 428 as illustrated in FIG. 4C has a "spider"-type shape, although other shapes and sizes for the suspension element 428 are envisioned. In operation, the suspension element 428 is configured to suspend the extended voice coil 400 within a magnet gap of a magnet structure (such as the magnet gap between the interior magnets 220, 221 and the exterior magnets 216-219 as discussed with respect to FIG. 2).

Figure 5A:
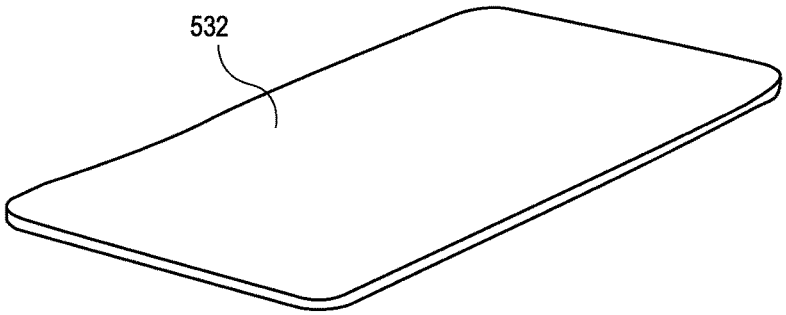
FIG. 5A depicts an example diaphragm in accordance with some embodiments.

FIG. 5A illustrates an example diaphragm 532 that may additionally be included as part of a transducer. The diaphragm 532 may be made of various materials having various sizes. For example, the diaphragm 532 can be composed of a thermally conducting material such as aluminum with dimensions of approximately 7.0 mm×16.4 mm×0.1 mm.

Figure 5B:
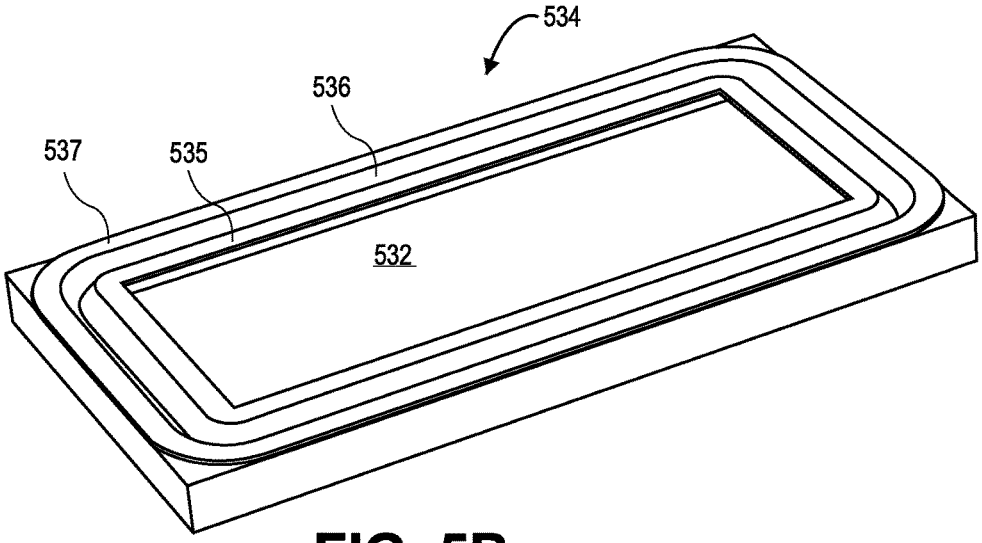
FIG. 5B depicts an example roll-surround suspension in accordance with some embodiments.

The diaphragm 532 is configured to secure to a roll-surround suspension 534 as illustrated in FIG. 5B. The roll-surround suspension 534 includes a mounting frame with an interior edge 535 and an exterior edge 537. The mounting frame may be various sizes such that the diaphragm 532 may be secured within the roll-surround suspension 534. For example, the mounting frame can have dimensions of 10.0 mm×19.4 mm. According to some embodiments, the diaphragm 534 is configured to secure under the interior edge 535 of the mounting frame.

Figure 5C:
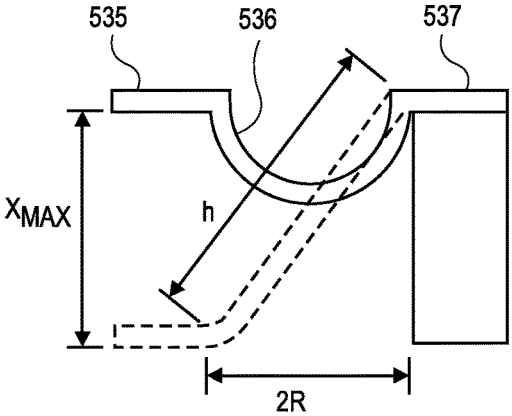
FIG. 5C depicts a detailed view of an example roll-surround suspension in accordance with some embodiments.

The roll-surround suspension 534 further includes a roll component 536 positioned between the interior edge 535 and the exterior edge 537, which is illustrated in more detail in FIG. 5C. The roll component 536 may be composed of various materials such as, for example, foamed silicone rubber, or other materials. The design of the roll component 536 enables excursion of the diaphragm 534 which produces audio output. Referring to FIG. 5C, the roll component 536 enables a maximum excursion distance of $X_{mas}$ according to formula (1):

$$R = \frac{Xmas}{(\pi^2 - 4)\wedge 0.5} \tag{1}$$

Accordingly, if the desired maximum excursion distance $X_{mas}$ is 1.0 mm, the radius R of the roll component 536 is 0.413 mm.

Figure 6A:
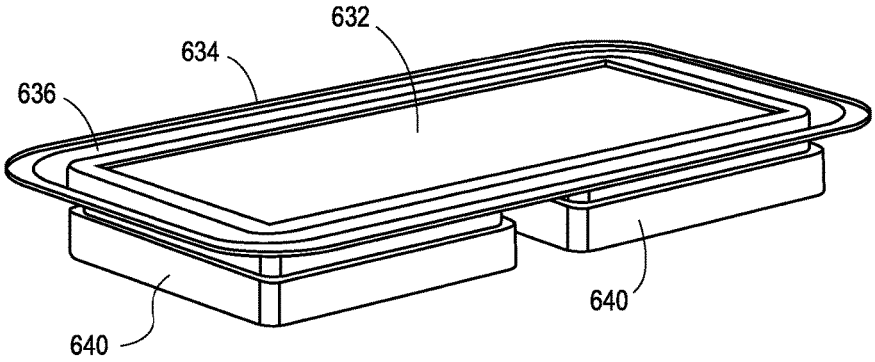
FIG. 6A depicts a portion of an example transducer in accordance with some embodiments.
Figure 6B:
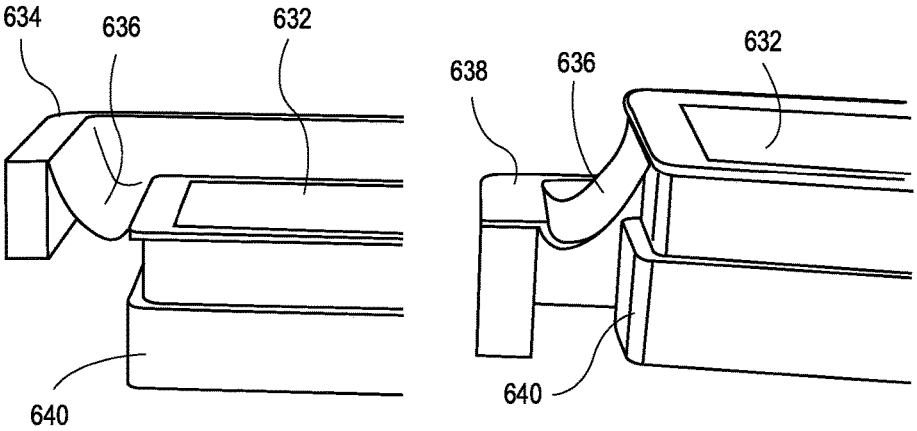
FIG. 6B depicts a detailed view of a diaphragm and a roll-surround suspension in accordance with some embodiments.

FIG. 6A illustrates a portion of a transducer including a roll-surround suspension 634 and a diaphragm 632 secured or coupled to a set of voice coils 640 (such as the extended voice coil 400). According to some embodiments, the set of voice coils 640 may secure to a bottom side or surface of the diaphragm 632 via various attachment mechanisms such as the set of tabs 430 as illustrated in FIG. 4A, or other attachment mechanisms. As discussed herein, a roll component 636 of the roll-surround suspension 634 enables excursion of the diaphragm 632. In operation, the diaphragm 632 may constrain the voice coils 640 to move axially through respective magnet gaps of a magnet structure (such as the magnet gaps between the interior magnets 220, 221 and the exterior magnets 216-219 as discussed with respect to FIG. 2). FIG. 6B illustrates a detailed view of the excursion capabilities of the roll-surround suspension 634 and the diaphragm 632. The left side of FIG. 6B depicts the diaphragm 632 at a certain excursion (e.g., a distance of about −0.7 mm) and the right side of FIG. 6B depicts the diaphragm 632 at another certain excursion (e.g., a distance of about +0.7 mm).

Figure 7A:
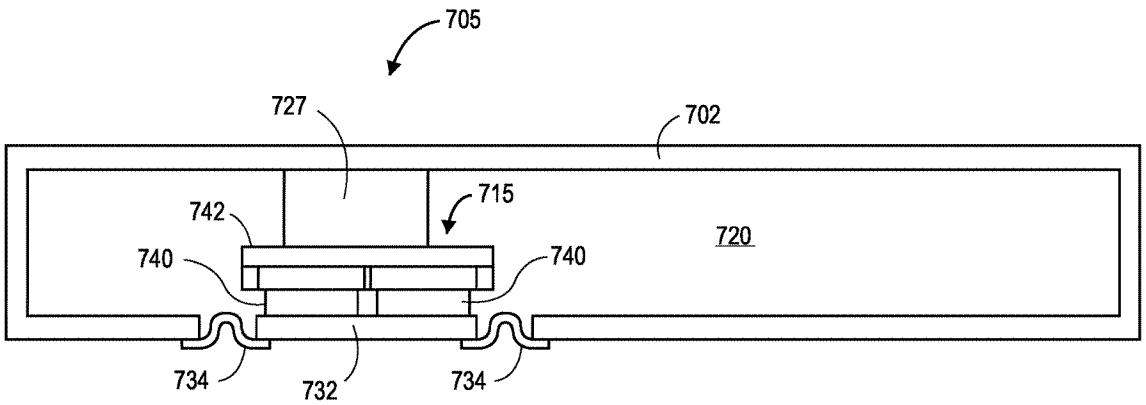
FIGS. 7A and 7B depict cross section views of an example electronic device in accordance with some embodiments.

FIG. 7A illustrates a cross-section view of an electronic device 705 (such as the electronic device 105 discussed with respect to FIG. 1). The electronic device 705 includes a transducer 715 disposed within a cutout area of an exterior casing 702 such that a diaphragm 732 of the transducer 715 is substantially coplanar with the exterior casing 702. The diaphragm 732 is secured to the exterior casing 702 via a roll-surround suspension 734 secured to a perimeter of the diaphragm 732.

The electronic device 705 further includes a pair of voice coils 740 that are secured or coupled to the interior side of the diaphragm 732. Each of the voice coils 740 may include a posterior portion and an anterior portion, where the anterior portion may be disposed as part of a motor structure 742 with interior and exterior magnets, and one or more support elements (such as the motor structure 300 discussed with respect to FIG. 3B).

In some implementations, the electronic device 705 can include a support component 727 disposed between the motor structure 742 and a portion of the exterior casing 702 (or another surface of the electronic device 705), wherein the support component 727 acts to physically support the transducer 715. The support component 727 may be composed of various materials or combinations of materials, such as foam, epoxy, and/or the like. In other embodiments, the transducer 715 may be physically supported by any internal component or surface of the electronic device 705. In further embodiments, there may be an air gap between the transducer 715 and the exterior casing 702 (or another surface of the electronic device 705).

As illustrated in FIG. 7A, the design of the electronic device 705 may define an air volume 720 within the exterior casing 702, wherein the air volume 720 is generally defined as an area that is not taken up by components of the electronic device 705. In specific implementations incorporating the diaphragm 732, the air volume 720 may be defined as the volume of air that is exposed to the interior side of the diaphragm 732. Generally, the air volume 720 enhances the displacement or vibration (i.e., excursion) capability of the diaphragm 732 and therefore enhances the frequency response of the audio output.

Figure 7B:
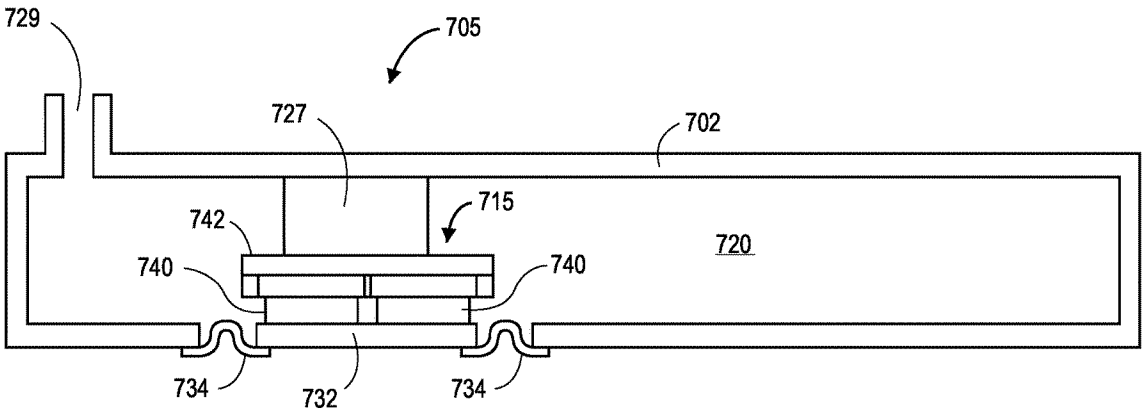

FIG. 7B depicts a cross-section view of an alternative design for the electronic device 705. The electronic device 705 of FIG. 7B includes a port 729 that extends through the exterior casing 702 (or another surface of the electronic device 705) and into the air volume 720 such that each of the port 729 and the diaphragm 732 is exposed to the air volume 720. In some embodiments, the port 729 may be incorporated into an existing jack, port, or socket of the electronic device 705. For example, the port 729 may be a 3.5 mm headphone jack, a USB port, or another jack or port. Although illustrated as generally narrow, it should be appreciated that the port 729 can be of various shapes and sizes. The port 729 may be designed and positioned such that its acoustic resonance is tuned by optimal selection of its cross-sectional area and length to provide enhanced audio output (e.g., additional low frequency acoustic radiation) via the diaphragm 732.

Figure 8:
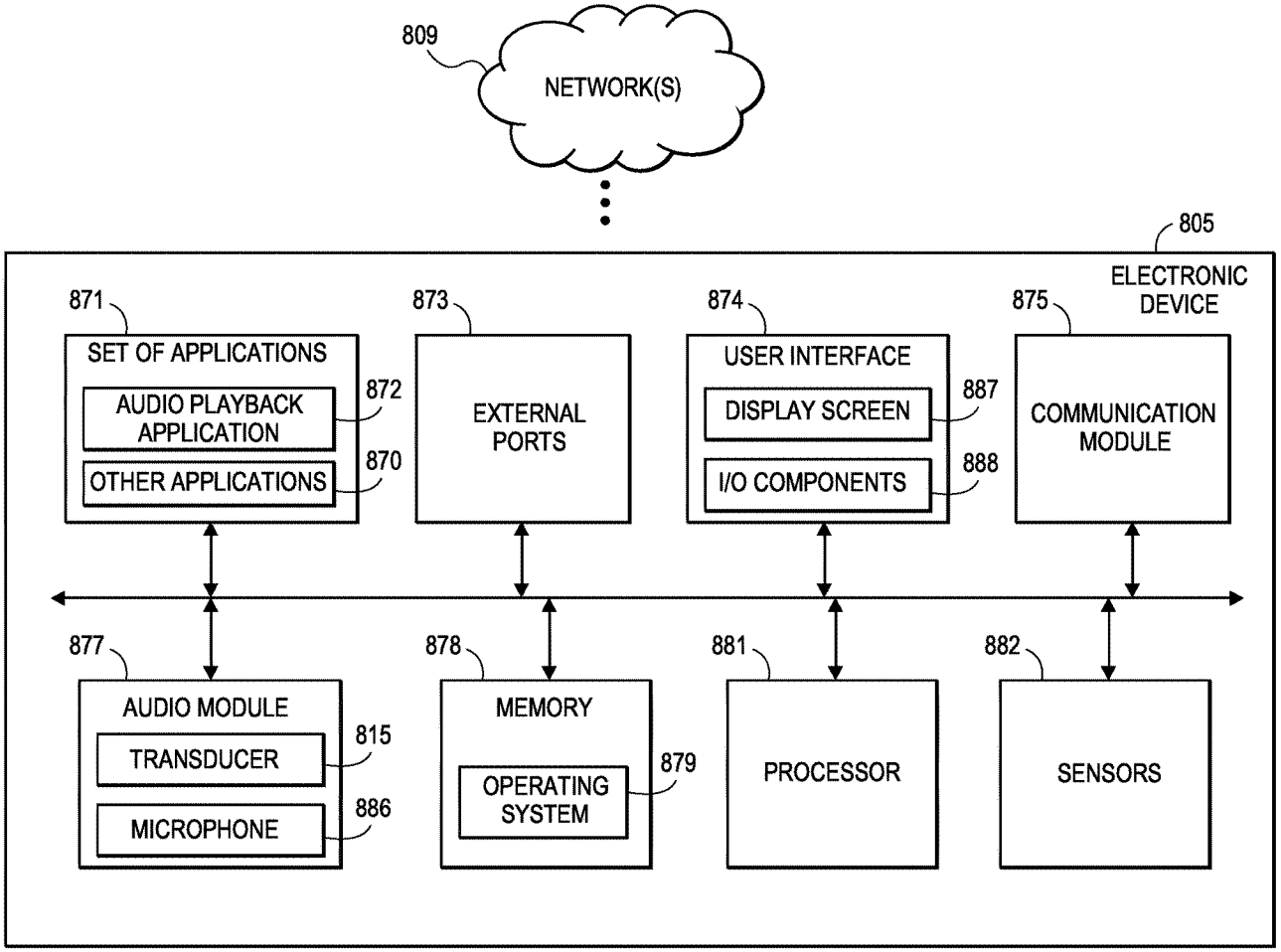
FIG. 8 is a block diagram of an electronic device in accordance with some embodiments.

FIG. 8 illustrates an example electronic device 805 in which the embodiments as discussed herein may be implemented. The electronic device 805 can include a processor 881 or other similar type of controller module or microcontroller, as well as a memory 878. The memory 878 can store an operating system 879 capable of facilitating various functionalities as known in the art. The processor 881 can interface with the memory 878 to execute the operating system 879, as well as execute a set of applications 871 such as an audio playback application 872 and one or more other applications 870 (which the memory 878 can also store). The memory 878 can include one or more forms of volatile and/or non-volatile, fixed and/or removable memory, such as read-only memory (ROM), electronic programmable read-only memory (EPROM), random access memory (RAM), erasable electronic programmable read-only memory (EEPROM), and/or other hard drives, flash memory, MicroSD cards, and others.

The electronic device 805 can further include a communication module 875 configured to interface with the one or more external ports 873 to communicate data via one or more networks 809. According to some embodiments, the communication module 875 can include one or more transceivers functioning in accordance with IEEE standards, 3GPP standards, or other standards, and configured to receive and transmit data via the one or more external ports 873. More particularly, the communication module 875 can include one or more WWAN, WLAN, and/or WPAN transceivers configured to connect the electronic device 805 to various devices and components.

The electronic device 805 can further include one or more sensors 882 such as, for example, imaging sensors, accelerometers, touch sensors, and other sensors. The electronic device 805 can include an audio module 877 including hardware components such as a transducer 815 for processing audio signals as discussed herein and a microphone 886 for detecting or receiving audio. In operation, the transducer 815 can receive an audio signal from a power source (e.g., via the processor 881) and mechanically vibrate according to the audio signal.

The electronic device 805 may further include a user interface 874 to present information to the user and/or receive inputs from the user. As shown in FIG. 8, the user interface 874 includes a display screen 887 and I/O components 888 (e.g., capacitive or resistive touch sensitive input panels, keys, buttons, lights, LEDs, cursor control devices, haptic devices, and others). In embodiments, the display screen 887 is a touchscreen display using singular or combinations of display technologies and can include a thin, transparent touch sensor component superimposed upon a display section that is viewable by a user. For example, such displays include capacitive displays, resistive displays, surface acoustic wave (SAW) displays, optical imaging displays, and the like.

In general, a computer program product in accordance with an embodiment includes a computer usable storage medium (e.g., standard random access memory (RAM), an optical disc, a universal serial bus (USB) drive, or the like) having computer-readable program code embodied therein, wherein the computer-readable program code is adapted to be executed by the processor 881 (e.g., working in connection with the operating system 879) to facilitate the functions as described herein. In this regard, the program code may be implemented in any desired language, and may be implemented as machine code, assembly code, byte code, interpretable source code or the like (e.g., via C, C++, Java, Actionscript, Objective-C, Javascript, CSS, XML, and/or others).

Thus, it should be clear from the preceding disclosure that the systems and methods offer improved audio playback implementations. The embodiments improve the user experience by enabling improved audio frequency response. Further, the embodiments advantageously leverage various features of electronic device design to improve audio playback while maintaining or improving the aesthetic appearance of the electronic devices.

This disclosure is intended to explain how to fashion and use various embodiments in accordance with the technology rather than to limit the true, intended, and fair scope and spirit thereof. The foregoing description is not intended to be exhaustive or to be limited to the precise forms disclosed. Modifications or variations are possible in light of the above teachings. The embodiment(s) were chosen and described to provide the best illustration of the principle of the described technology and its practical application, and to enable one of ordinary skill in the art to utilize the technology in various embodiments and with various modifications as are suited to the particular use contemplated. All such modifications and variations are within the scope of the embodiments as determined by the appended claims, as may be amended during the pendency of this application for patent, and all equivalents thereof, when interpreted in accordance with the breadth to which they are fairly, legally and equitably entitled.

What is claimed is:

1. A transducer for an electronic device, comprising:
- a magnet section comprising:
  - two interior magnets, and
  - a set of exterior magnets surrounding the two interior magnets, wherein a gap is formed between the set of exterior magnets and the two interior magnets;
- two voice coils, each comprising:
  - an anterior portion surrounding a respective interior magnet of the two interior magnets, and
  - a posterior portion (i) secured to the anterior portion, (ii) having a posterior perimeter offset from a perimeter of the anterior portion, and (iii) extending above the respective interior magnet of the two interior magnets; and
- a diaphragm secured to the two voice coils.

2. The transducer of claim 1, further comprising:
- a roll-surround suspension secured to a perimeter of the diaphragm.

3. The transducer of claim 1, further comprising:
- two suspension elements respectively secured within the posterior portion of the two voice coils.

4. The transducer of claim 3, wherein the posterior portion comprises a set of slots formed thereon, and wherein the respective suspension element comprises a set of tabs configured to secure within the set of slots.

5. The transducer of claim 1, wherein the magnet section further comprises:
- at least one metallic support element disposed above and below at least the set of exterior magnets.

6. An electronic device configured to output audio, comprising:
- an exterior casing having a cutout area formed therethrough;
- a transducer comprising:
  - two interior magnets each having a magnetic pole oriented in a first direction,
  - a set of exterior magnets surrounding the two interior magnets,
  - two voice coils, each comprising:
    - an anterior portion surrounding a respective interior magnet of the two interior magnets, and
    - a posterior portion (i) secured to the anterior portion, (ii) having a posterior perimeter offset from a perimeter of the anterior portion, and (iii) extending above the respective interior magnet of the two interior magnets, and
  - a diaphragm secured to the two voice coils; and
- a roll-surround suspension coupled to a perimeter of the diaphragm such that the transducer is disposed within the cutout area of the exterior casing.

7. The electronic device of claim 6, wherein the diaphragm is substantially coplanar with at least a portion of the exterior casing.

8. The electronic device of claim 6, wherein the transducer further comprises:
- an additional interior magnet positioned between the two interior magnets and between the two voice coils.

9. The electronic device of claim 6, wherein the transducer further comprises:
- two suspension elements respectively secured within the posterior portion of the two voice coils.

10. The electronic device of claim 9, wherein the posterior portion comprises a set of slots formed thereon, and wherein the respective suspension element comprises a set of tabs configured to secure within the set of slots.

11. The electronic device of claim 6, wherein the transducer further comprises:
- at least one metallic support element disposed above and below at least the set of exterior magnets.

12. The electronic device of claim 6, wherein the exterior casing encloses an air volume, wherein at least a portion of an interior surface of the diaphragm is exposed to the air volume.

13. The electronic device of claim 6, wherein the exterior casing comprises a port formed therethrough, wherein each of the port and at least a portion of the diaphragm is exposed to an air volume within the exterior casing.

14. The electronic device of claim 6, further comprising:
- a support component disposed between the transducer and an internal surface of the electronic device.

15. The electronic device of claim 6, further comprising:
- a power source configured to apply an electrical signal to the two voice coils to cause the diaphragm to actuate and produce sound.

16. The electronic device of claim 6, wherein the diaphragm is secured to the two voice coils via a respective set of tabs formed on each of the two voice coils.

17. A motor structure for a transducer, comprising:
- two interior magnets;

a set of exterior magnets surrounding the two interior magnets and forming a gap between the set of exterior magnets and the two interior magnets; and two voice coils respectively disposed at least partially within the gap, each comprising:

an anterior portion surrounding a respective interior magnet of the two interior magnets, and a posterior portion (i) secured to the anterior portion, (ii) having a posterior perimeter offset from a perimeter of the anterior portion, and (iii) extending above the respective interior magnet of the two interior magnets.

18. The motor structure of claim 17, further comprising:

two suspension elements respectively secured within the posterior portion of the two voice coils.

19. The motor structure of claim 18, wherein the posterior portion comprises a set of slots formed thereon, and wherein the respective suspension element comprises a set of tabs configured to secure within the set of slots.

20. The motor structure of claim 17, further comprising:

at least one metallic support element disposed above and below at least the set of exterior magnets.

* * * * *